US005915813A

United States Patent [19]

Joiner

[11] Patent Number: 5,915,813

[45] **Date of Patent: *Jun. 29, 1999**

[54] APPARATUS AND METHOD FOR DRYING A WET WEB AND MODIFYING THE MOISTURE PROFILE THEREOF

[75] Inventor: John R. Joiner, Vancouver, Wash.

[73] Assignee: Fort James Corporation, Richmond, Va.

[ * ] Notice: This patent is subject to a terminal disclaimer.

[21] Appl. No.: 08/651,890

[22] Filed: May 21, 1996

[51] Int. Cl.[6] ..... F26B 11/02

[52] U.S. Cl. ..... 34/115; 34/114; 34/120; 34/122; 34/123

[58] Field of Search ..... 34/114, 115, 117, 34/122, 123, 116, 120, 124

[56] References Cited

U.S. PATENT DOCUMENTS

| | | | |
|---|---|---|---|
| 3,303,576 | 2/1967 | Sisson . | |
| 3,340,617 | 9/1967 | Carroll, Jr. . | |
| 3,418,723 | 12/1968 | Burgess et al. | 34/265 |
| 3,432,936 | 3/1969 | Cole et al. . | |
| 3,447,247 | 6/1969 | Daane | 34/122 |
| 3,541,697 | 11/1970 | Villalobos . | |
| 3,821,068 | 6/1974 | Shaw . | |
| 3,891,500 | 6/1975 | Kankaanpaa . | |
| 3,919,783 | 11/1975 | Cirrito . | |
| 4,462,868 | 7/1984 | Oubridge et al. . | |
| 4,654,981 | 4/1987 | Grebe et al. . | |
| 5,150,535 | 9/1992 | Fleissneer . | |
| 5,174,046 | 12/1992 | Chern . | |
| 5,397,437 | 3/1995 | Ingemar . | |
| 5,416,979 | 5/1995 | Joiner . | |
| 5,425,852 | 6/1995 | Joiner . | |
| 5,465,504 | 11/1995 | Joiner . | |

*Primary Examiner*—Henry A. Bennett
*Assistant Examiner*—Pamela A. O'Connor
*Attorney, Agent, or Firm*—Burns, Doane, Swecker & Mathis, L.L.P.

[57] ABSTRACT

Apparatus and method for drying a wet web and modifying the moisture profile of the web. A plurality of gas burners are located within the interior of a through air dryer hood to variably heat air passing through the hood interior before it contacts a wet web on a through air dryer web support. The flowing air within the hood interior is divided into air flow portions directed toward different incremental width portions of the wet web. The burners are separately controlled to vary the heat of the individual flowing air portions to provide a uniform web moisture profile.

23 Claims, 7 Drawing Sheets

APPARATUS AND METHOD FOR DRYING A WET WEB AND MODIFYING THE MOISTURE PROFILE THEREOF

TECHNICAL FIELD

This invention relates to an apparatus and a method for drying a wet web and controlling the moisture profile of the web during manufacture. The apparatus and method of the invention disclosed herein have particular application to through air drying a wet paper web during manufacture.

BACKGROUND ART

My U.S. Pat. No. 5,416,979, issued May 23, 1995, discloses apparatus for drying a wet paper web during manufacture of the paper web. The apparatus allows the moisture profile of the web to be carefully controlled and adjusted. The apparatus includes a rotatable yankee dryer drum and a hood partially encompassing the rotatable dryer drum. A plurality of elongated heater nozzle boxes are disposed in the hood interior and extend across the dryer drum in the cross-machine direction, the elongated heater nozzle boxes being arrayed side-by-side in the machine direction. A plurality of gas burners is located in each of the nozzle box interiors and arranged side-by-side along the length of the nozzle box interiors for producing hot combustion gases within the nozzle box interiors of the heater nozzle boxes.

My U.S. Pat. No. 5,425,852, issued Jun. 20, 1995, discloses a system for reducing blistering of a wet paper web on a yankee dryer. Blistering is controlled by directing compressed dry air toward the wet paper web in the space between a pressure roll external of the yankee dryer hood and the entry opening between the dryer hood and the yankee dryer drum. The flow of compressed air is controlled so that air flow can be modified across the full width of the wet paper web.

My U.S. Pat. No. 5,465,504, issued Nov. 14, 1995, discloses drying a paper web on a yankee dryer. The moisture profile is controlled by arraying a plurality of gas burners in a cross-machine direction within the yankee dryer hood to direct heat toward incremental width portions of the paper web.

The present invention relates to drying a wet web and modifying the moisture profile. In the disclosed embodiment, the invention is employed to modify the moisture profile of a wet paper web while the paper web is being manufactured in a system utilizing a through air dryer; however, the principles of the invention are applicable to drying other types of webs. Through air dryers are well known expedients for drying wet paper webs, particularly tissue webs, conventionally employing a through air dryer roll for supporting and transporting the wet paper web and a through air dryer hood cooperable with the through air dryer roll to cause the passage of hot air through the through air dryer roll and the wet paper web thereon to dry the wet paper web. Flat bed through air dryers not employing a through air dryer roll and instead employing other forms of web support structure are also known and the principles of the present invention are applicable to such systems as well.

Through air dryers are shown, for example, in the following United States patents: U.S. Pat. No. 3,303,576, issued Feb. 14, 1967, U.S. Pat. No. 3,432,936, issued Mar. 18, 1969, and U.S. Pat. No. 3,821,068, issued Jun. 28, 1974.

It is, of course, highly desirable to maintain a uniform moisture profile in a paper web during manufacture thereof in order to attain a high quality end product of uniform character. Through air dry systems present major problems with respect to obtaining and maintaining web uniform moisture profiles.

The problem is that through air dryers rely upon the passage of heated air through the wet paper web to accomplish drying. Any differences in the moisture profile of the wet paper web are actually amplified during the through drying process since web permeability is higher in the drier areas of the web and these areas will tend to dry faster than the wetter, less permeable portions of the web. In other words, the drier portions of the web tend to get even drier relative to the wetter portions. In order to overcome this problem it has been the practice in the prior art to "over dry" the entire web in order to obtain a degree of uniform dryness. This, of course, is highly wasteful of energy.

Conventional through air dryer arrangements have other drawbacks as well. Typically, conventional through air dryers require large volume combustion and air mixing chambers aimed at uniformly distributing heat. These arrangements take up considerable physical space and are capital intensive. Through air dryers conventionally employ structures within the hood interior, such as turning vanes, which are for the purpose of receiving heated air from a separate combustion chamber and distributing it uniformly prior to engagement with the wet paper web being dried in an attempt to maintain a uniform moisture profile. These mechanisms are not only complicated and expensive but are not as effective as desired from the stand point of maintaining a level moisture profile. Fan pressure loss and requirement for bulky and extensive duct work are additional problems in the prior art.

In addition to the patents noted, above the following United States patents are considered representative of the current state of the prior art: U.S. Pat. No. 5,397,437, issued Mar. 14, 1995, U.S. Pat. No. 5,174,046, issued Dec. 29, 1992, U.S. Pat. No. 5,150,535, issued Sep. 29, 1992, U.S. Pat. No. 4,654,981, issued Apr. 7, 1987, U.S. Pat. No. 4,462,868, issued Jul. 31, 1984, U.S. Pat. No. 3,919,783, issued Nov. 18, 1975, U.S. Pat. No. 3,891,500, issued Jun. 24, 1975, U.S. Pat. No. 3,541,697, issued Nov. 24, 1970, and U.S. Pat. No. 3,340,617, issued Sep. 12, 1967.

DISCLOSURE OF INVENTION

The present invention relates to an apparatus and to a method which are highly effective in controlling the moisture profile of a wet web being through air dried. The invention, as disclosed, is employed to dry a wet paper web; however, the principles of the invention are applicable to dry other types of webs. The present invention allows the elimination of the large combustion and air mixing chambers typically employed in prior art through air dry arrangements. Consequently, the apparatus constructed in accordance with the teachings of the present invention occupies less physical space and requires a lower capital expenditure than typical prior art systems. Fan pressure loss commonly associated with prior art arrangements is minimized. Temperature and air flow distribution in the through air drier hood interior is less critical with the arrangement of the present invention as compared to prior art arrangements because a profiling burner incorporated in the apparatus can readily compensate for variations. A considerable improvement in product quality results due to the fact that the apparatus and method of the present invention provide a readily attained level moisture profile and the product need not be overdried.

The burner is much closer to the web when it is located in the hood than conventional. The volume of heated air between the burner and the web is small compared to conventional. This allows the hot supply air to cool down faster in the event the web is interrupted. This is important in tissue applications because the wet web protects a supporting fabric which cannot tolerate the hot supply air temperature.

The apparatus of the present invention is for the purpose of drying a wet web, such as a wet paper web, and modifying the moisture profile of the wet web.

The apparatus includes a through air dryer hood defining a hood interior and at least one air supply inlet communicating with the hood interior.

A through air dryer support, such as a through air dryer roll, is mounted for movement relative to the through air dryer hood, the through air dryer web support for engaging a wet web as the web moves in a machine direction in communication with the hood interior.

Heater means is located within the hood interior for heating air within the hood interior during movement of the air from the air supply inlet to the through air dryer web support for drying the wet web.

The heater means comprises a plurality of gas burners located within the hood interior. The gas burners are disposed alongside one another in the cross-machine direction with each gas burner extending only part way along the length of the through air dryer support.

The apparatus additionally comprises air flow separator means located between the gas burners and the through air dryer roll for dividing air flowing through the hood interior between the gas burners and the through air dryer support into separate air flow portions. Each of the air flow portions is directed toward an incremental width portion of the wet web engaging the through air dryer web support.

The present invention also encompasses a method of drying a wet web and modifying the moisture profile of the wet web.

The method includes the step of transporting a wet web in a machine direction with the wet web in engagement with a web support having openings therein.

The method also includes the step of directing flowing air through a passageway and into engagement with the wet web while the wet web is in engagement with the web support.

The flowing air is passed through the wet web and through the openings of the web support.

While the flowing air is in the passageway, the flowing air is divided into a plurality of air flow portions disposed side-by-side.

The air flow portions are separately heated. The method also includes a step of engaging the wet web with said heated air flow portions along different incremental wet web width portions. The heat applied to the air flow portions during the heating step is independently varied.

Other features, advantages, and objects of the present invention will become apparent with reference to the following description and accompanying drawings.

BEST MODE FOR CARRYING OUT THE INVENTION

Figure 1:
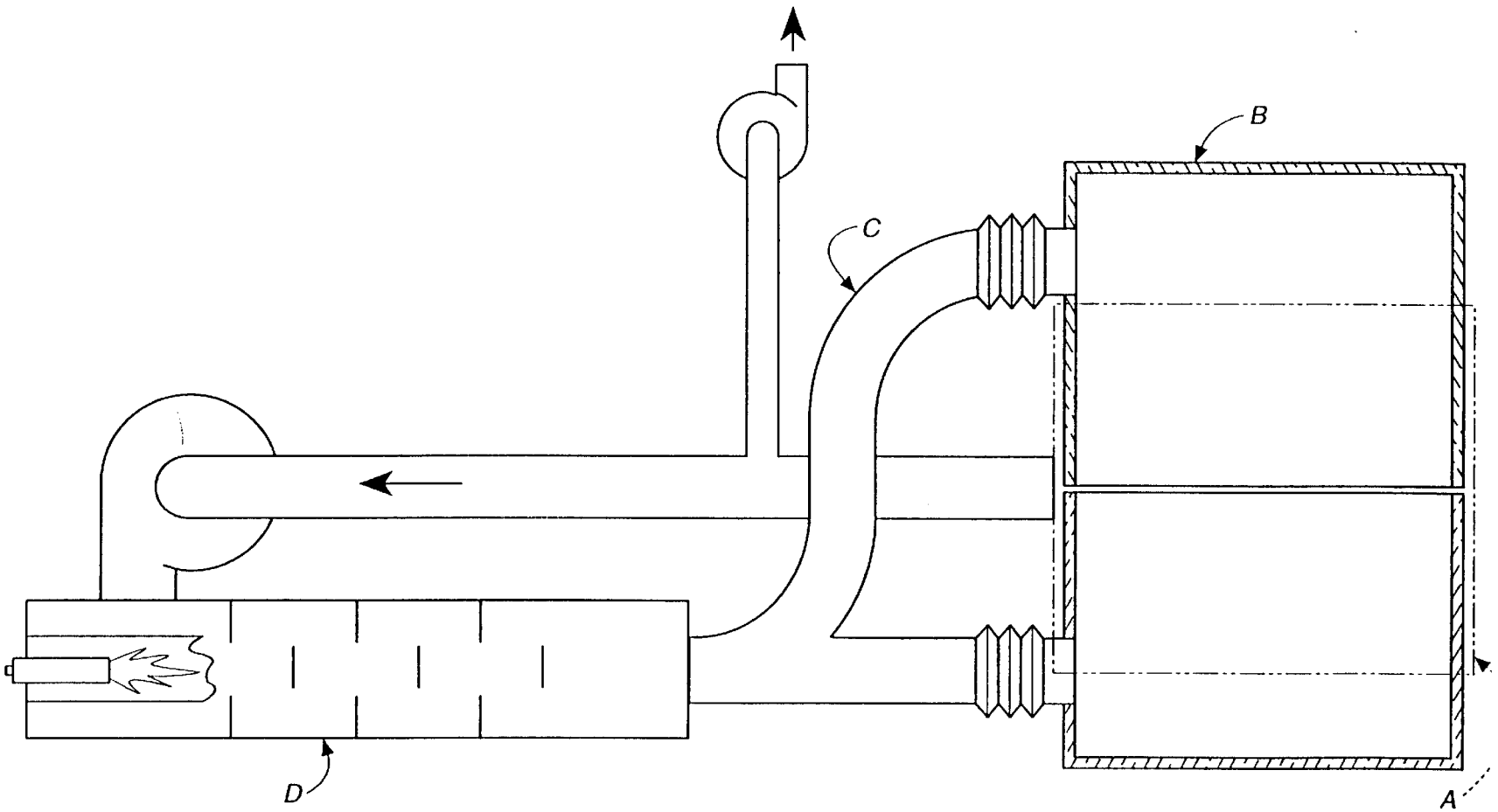
FIG. 1 (PRIOR ART)
FIG. 1 is a simplified schematic diagram illustrating the principle of operation of a typical prior art through air dryer for drying wet paper webs.

FIG. 1 is a highly simplified depiction of a typical prior art through air dryer approach. A through air dryer roll A is rotatably disposed in communication with the interior of a through air dryer hood B. Duct work C having articulated joints delivers hot air to and from the hood and roll to cause movement of dryer air through the roll. A separate combustion chamber D heats the air before it is recirculated back to the through air dryer per se. Air mixing devices are conventionally incorporated in the combustion chamber. Such arrangements are massive and have difficulty uniformly drying the wet paper web. Turning vanes or other stationary devices (not shown) are often employed in the hood, adding to the mass and complexity of the system without properly solving the problem of nonuniform moisture profile in a satisfactory manner.

Referring now to the other Figures of the drawing, apparatus constructed in accordance with the teachings of the present invention includes a through air dryer hood 12 defining a hood interior 14. The hood includes a wet end hood section 16 and a dry end hood section 18. As is conventional, these hood sections retract or move relative to the roll by suitable mechanism to allow access by persons performing such tasks as repair and maintenance.

Figure 4:
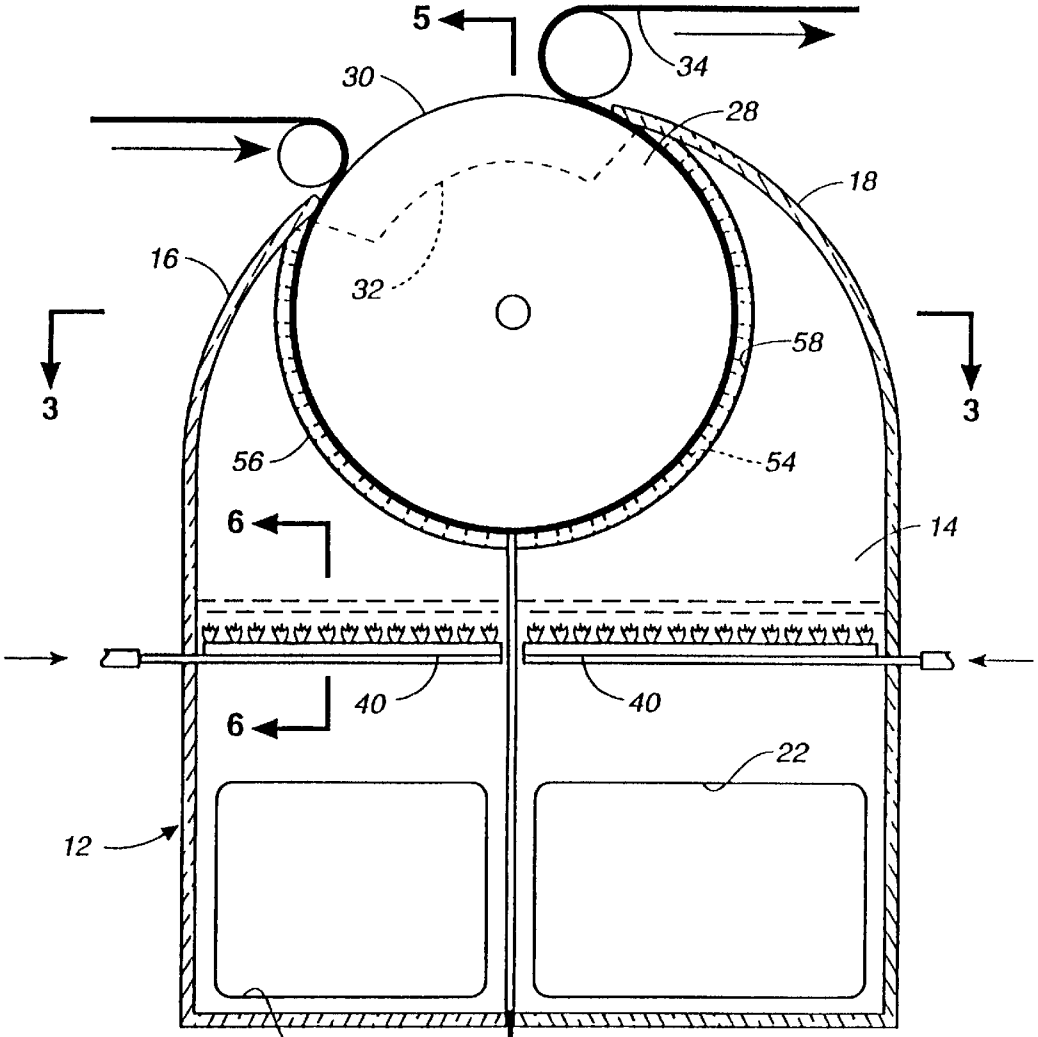
FIG. 4 is a somewhat diagrammatic, cross-sectional side view of apparatus constructed in accordance with the teachings of the present invention drying a moving wet paper web.

An air supply inlet 20 is provided for wet end hood section 16 and an air supply inlet 22 is provided for dry end hood section 18 (FIG. 4). These inlets are operatively associated with suitable ducts (not shown) which are incorporated in the through air dryer system and utilized to circulate air therethrough in the conventional manner. Such duct work need not be associated with a separate combustion or heater chamber of the type employed in the prior art.

Rotatably mounted relative to the through air dryer hood is a through air dryer roll 28 having an outer cylindrical wall 30 defining a plurality of openings therein providing communication between the through air dryer roll and the hood interior. In the interest of simplicity, the openings are only shown in FIG. 2. As is conventional, suitable means such as motorized fan structure (not shown) is provided to apply a vacuum to the interior of the through air dryer roll to promote the flow of air therethrough. An interior seal 32 (shown in hidden lines in FIG. 4) which is stationary is provided at the upper portion of the through air dryer roll to prevent the ingress of atmospheric air into the roll.

The through air dryer roll 28 during operation of the apparatus supports a wet paper web 34 (FIG. 4) moving in the machine direction and the drying air proceeding upwardly from inlets 20, 22 engages the wet paper web and passes therethrough as well as through the through air dryer roll to dry the web.

Figure 2:
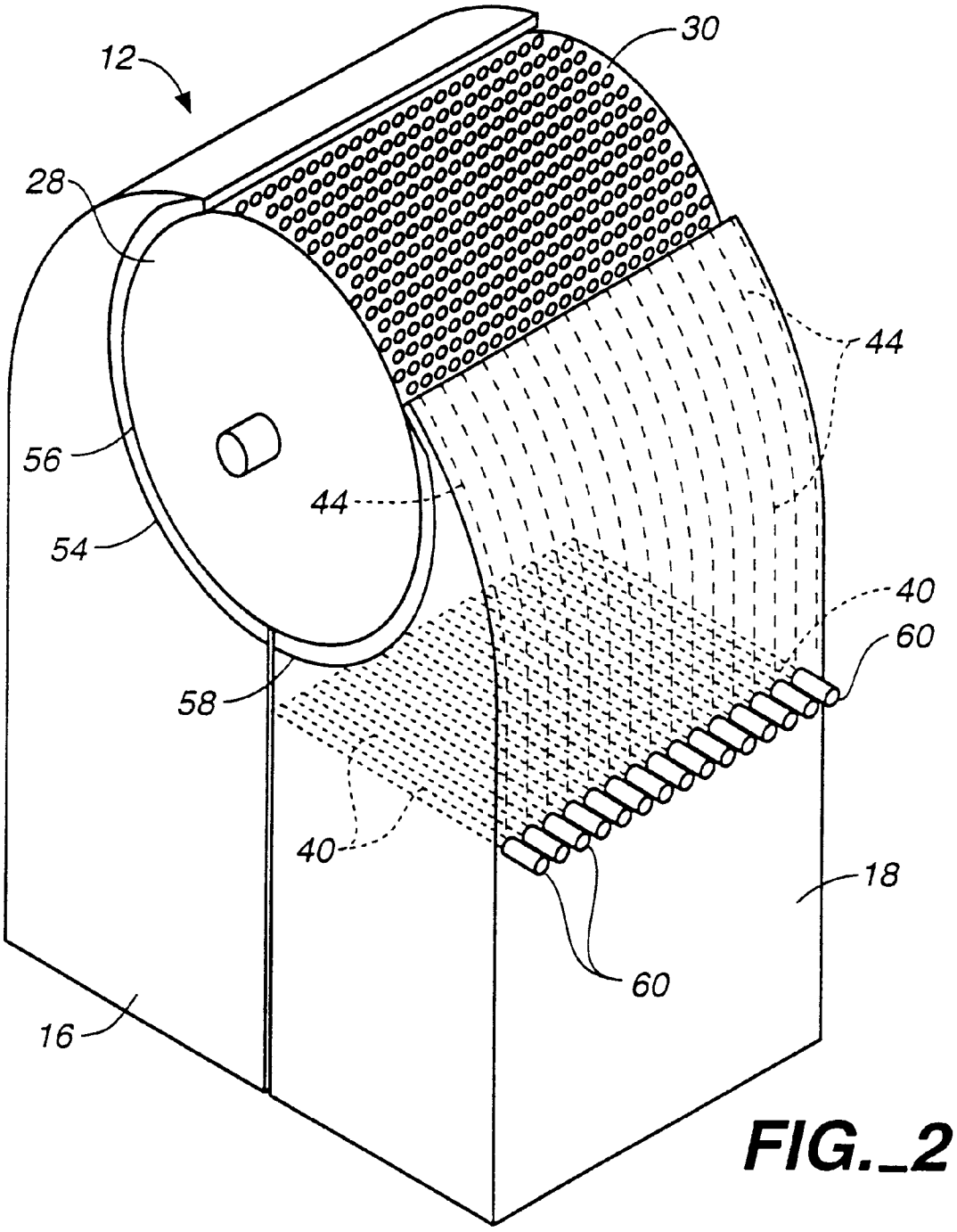
FIG. 2 is a somewhat simplified, diagrammatic, perspective view of a through air dryer roll and hood combined with selected components of apparatus constructed in accordance with the teachings of the present invention.
Figure 3:
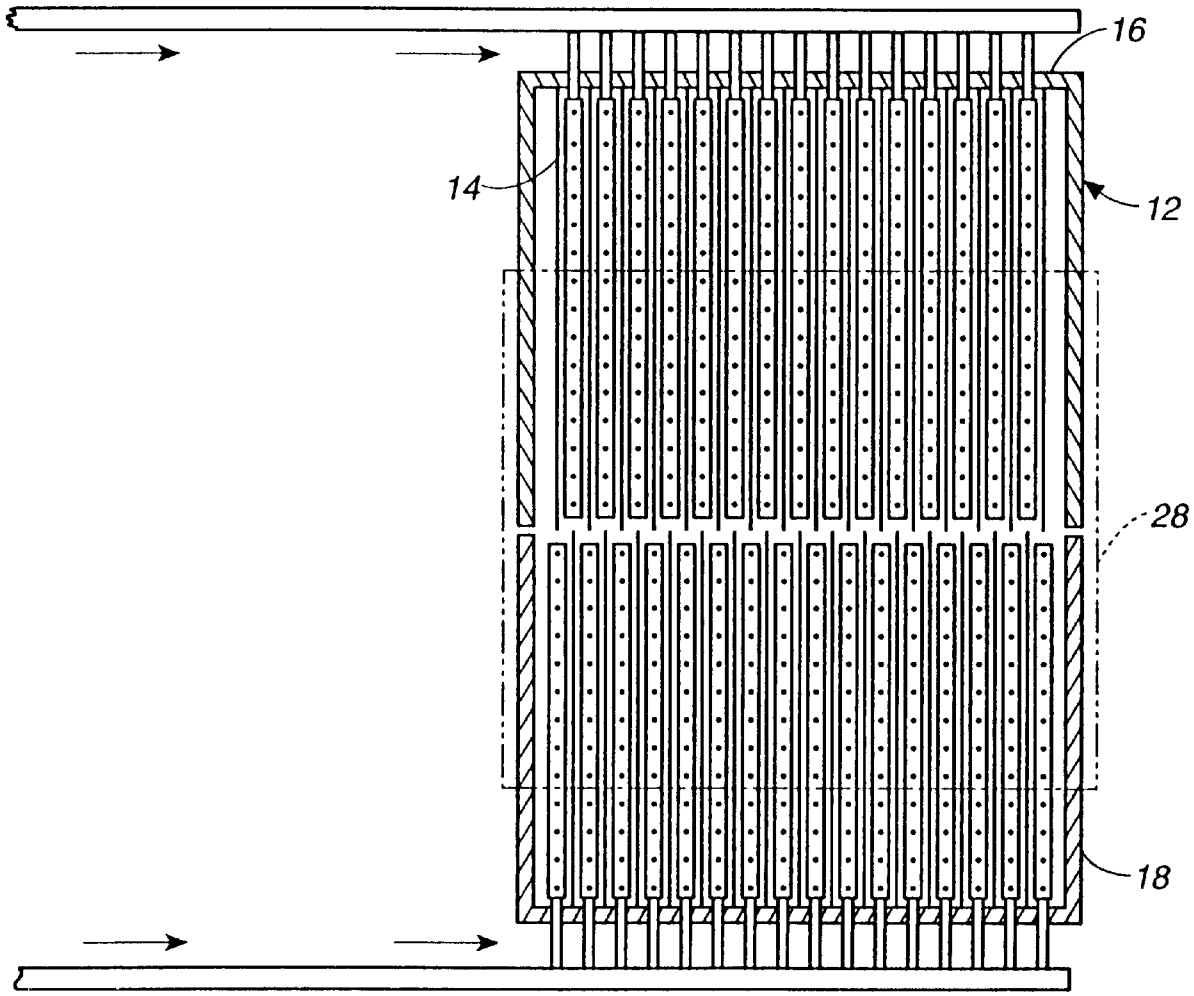
FIG. 3 is a cross-sectional diagrammatic view taken along the lines 3—3 in FIG. 4.
Figure 5:
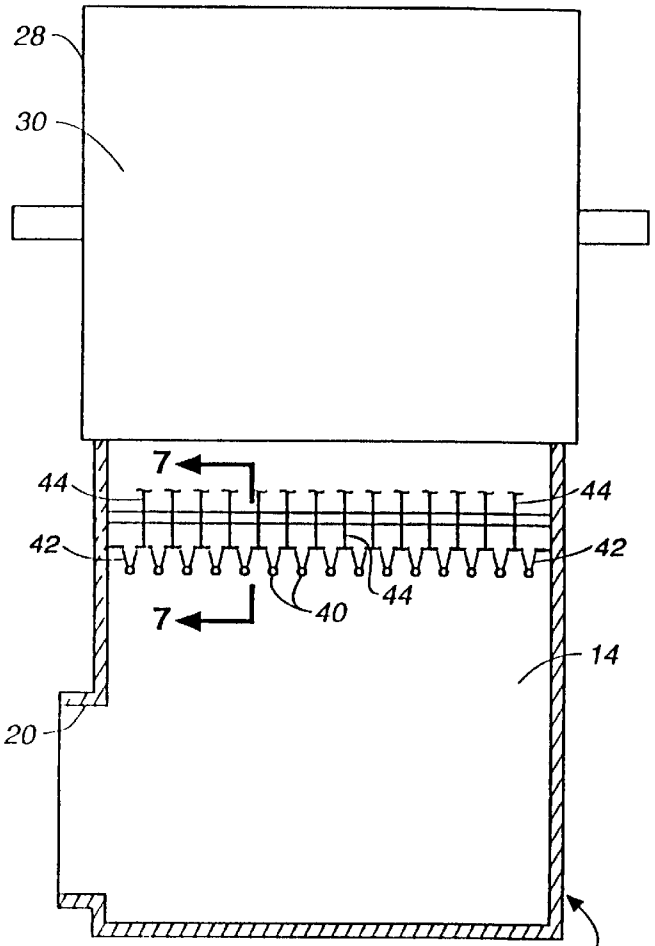
FIG. 5 is a partial cross-sectional view taken along the line 5—5 in FIG. 4.

Located in each of the hood sections 16 and 18 are a plurality of gas burners or nozzles 40 which are elongated and disposed alongside one another in the cross-machine direction. In the interest of simplicity, FIG. 2 depicts only the burners in section 18. Each gas burner extends only part way along the length of the through air dryer roll. A flame shield 42 in the form of two diverging shield walls extends upwardly from each of the gas burners to protect the flame from the cooler supply air until the combustion process is complete.

Located between adjacent gas burners or nozzles 40 and having lower edges disposed a distance above the burners are partitions or plates 44 which define a plurality of heated air flow channels 46 substantially centered over the burners. The partitions 44 serve to divide air flowing through the hood interior between the gas burners and the through air dryer roll into separate air flow portions, each of the air flow portions being directed toward an incremental width portion of the wet paper web engaging the through air dryer roll outer cylindrical wall.

It will be appreciated that each air flow portion is heated by a particular burner as air moves from the air supply inlets 20, 22 to the through air dryer roll. By adjusting the heat applied to the air flow portions by their respective gas burners, a varied heat profile may be applied to the wet paper web, thus modifying the moisture profile of the wet paper web.

Disposed above the gas burners 40 is mixing means for mixing and creating turbulence in each of the air flow portions prior to engagement thereof with the wet paper web. The mixing means comprises a plurality of mixing elements in the form of a plurality of spaced, flat bars 50 in the heated flow channels which are impacted by the air flowing through the hood interior. These mixing bars promote heat distribution uniformity with respect to each of the air flow portions.

The numbers of gas burners or nozzles employed will, of course, depend upon such factors as the size of the through air dryer roll and the size of the width portion of the wet paper web to be impacted by a particular air flow portion. Six inches, for example, is a representative air flow channel width.

The apparatus incorporates yet other structure for distributing air flow to the wet paper web on the through air dryer roll. In particular, the apparatus includes a perforated plate 54 which curves about and generally conforms to the shape of the through air dryer roll cylindrical wall. Perforated plate 54 includes two plate sections 56, 58 which comprise portions of wet end hood section 16 and dry end hood section 18, respectively. These plate sections of course separate when the hood sections are moved away from the roll during maintenance, repair, etc.

Each of the gas burners or nozzles 40 receive a mixture of a combustible gas such as natural gas and air to fuel the burner flame. The gas burners are controlled so that the flowing air portions heated thereby are heated to the desired extent as necessary to provide an even moisture profile in the wet paper web; that is, the wetter segments of the web will have more heat applied to them than do the drier segments.

Figure 8:
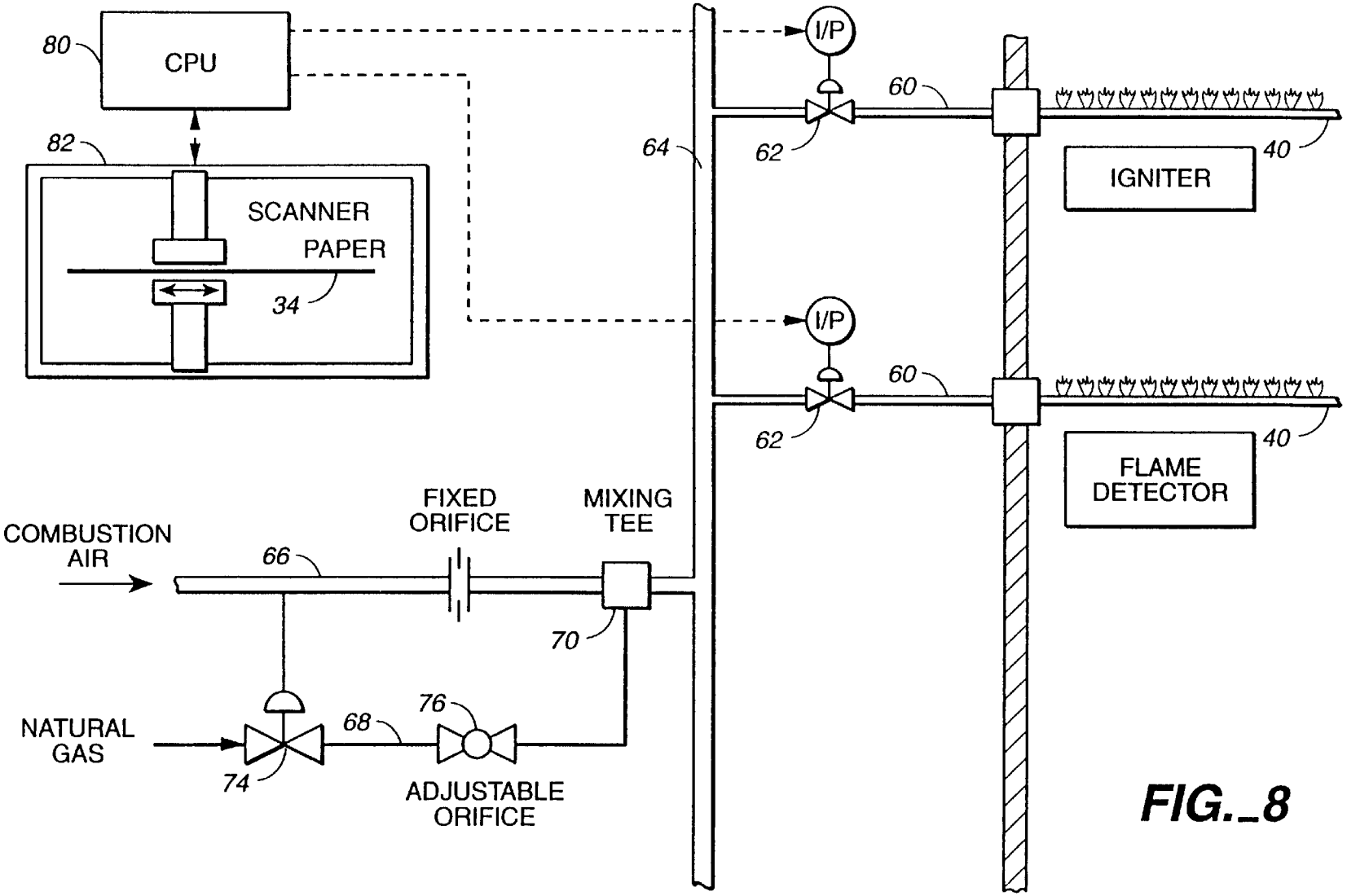
FIG. 8 is a schematic plan view illustrating one configuration of control means for controlling operation of gas burners of the apparatus.

FIG. 8 illustrates one approach for regulating the heat applied to the gas burners. In this arrangement each gas burner is fed by a supply line 60 having a control valve 62 operatively associated therewith. A header 64 is in flow communication with supply lines 60 and delivers a combination of natural gas and combustion air thereto, the combustion air being delivered through an air supply pipe 66 and the natural gas being delivered by a gas supply pipe 68. Supply pipes 66, 68 join at a mixing tee 70.

In the arrangement shown in FIG. 8 a fixed orifice 72 is located in air supply pipe 66. A control valve 74 is disposed in gas supply pipe 68 and operation thereof is controlled as a function of the air flow in air supply pipe 66 to maintain a desired ratio between the air and the natural gas. An adjustable orifice 76 is disposed in gas supply line 68.

A suitably programmed central processing unit 80 of any known commercial type controls control valves 62 to vary the heat of the various gas burners in accordance with the moisture profile sensed in moving web 34. Any suitable known commercially available scanning moisture gauge 82 can be employed for such purpose, the scanning moisture gauge sending appropriate signals to the CPU 80. Preferably, the moisture profile of the wet paper web is sensed at a location just down stream from the through air dryer so that the gas burners may be adjusted appropriately.

Figure 9:
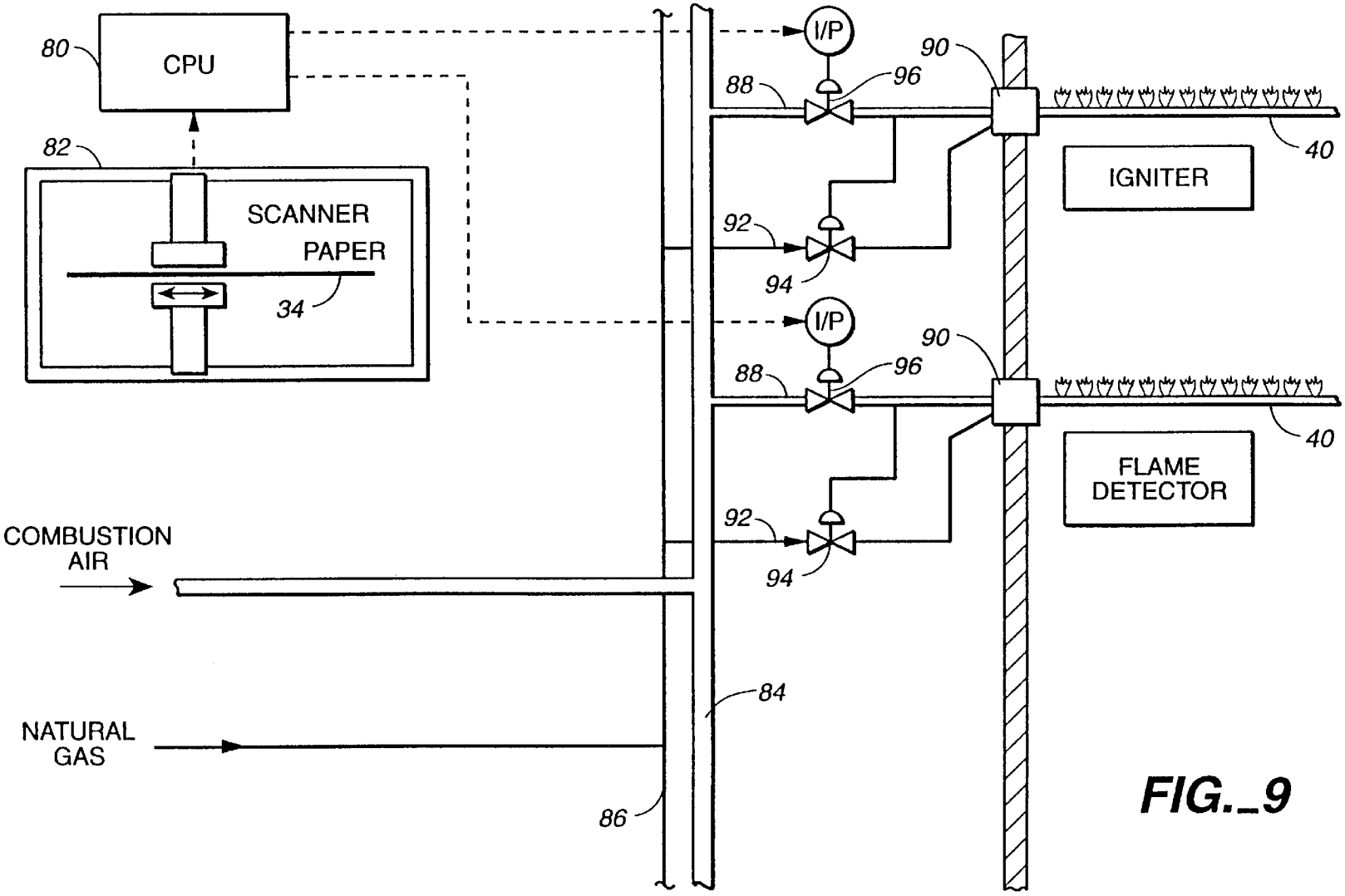
FIG. 9 is a view similar to FIG. 8 but illustrating an alternative control configuration.

FIG. 9 shows another combustion air/natural gas supply and control arrangement wherein the combustion air is delivered to an air header 84 and the natural gas is delivered to a separate gas header 86. Air supply lines 88 lead to mixing nozzles 90 at the input end of the gas burners. Gas supply lines 92 lead to the mixing nozzles from gas header 86. The mixing nozzles 90 are of conventional construction, containing internal orifices to maintain air/gas ratio. Control valves 94 are located in gas supply lines 92 and are controlled by sensed air pressure in air supply lines 88 to maintain the desired ratio between the combustion air and the natural gas.

Control valves 96 in air supply lines 88 are controlled by central processing unit 80 which in turn receives input from scanning moisture gauge 82.

Figure 6:
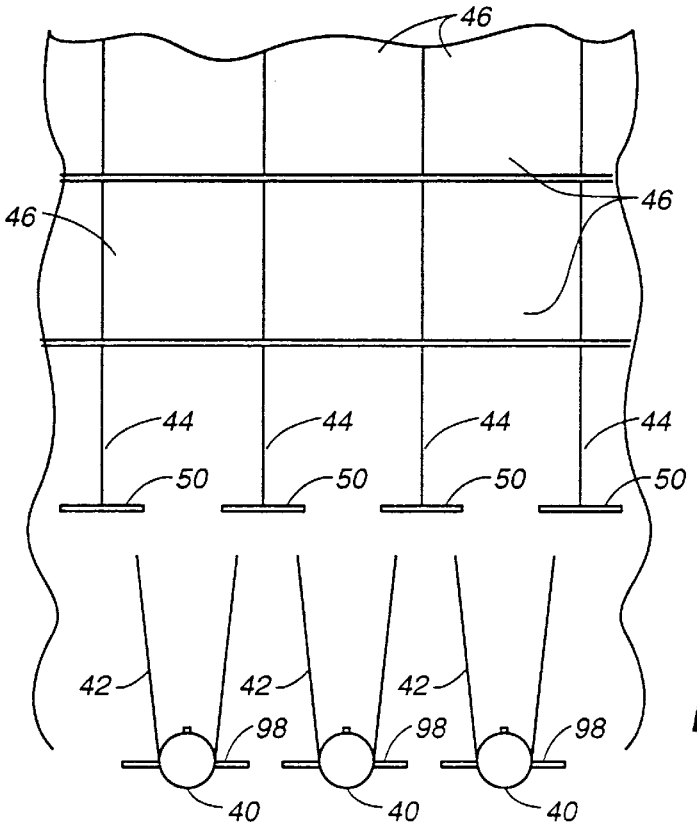
FIG. 6 is a diagrammatic view depicting a portion of the apparatus as designated by line 6—6 in FIG. 4.
Figure 7:
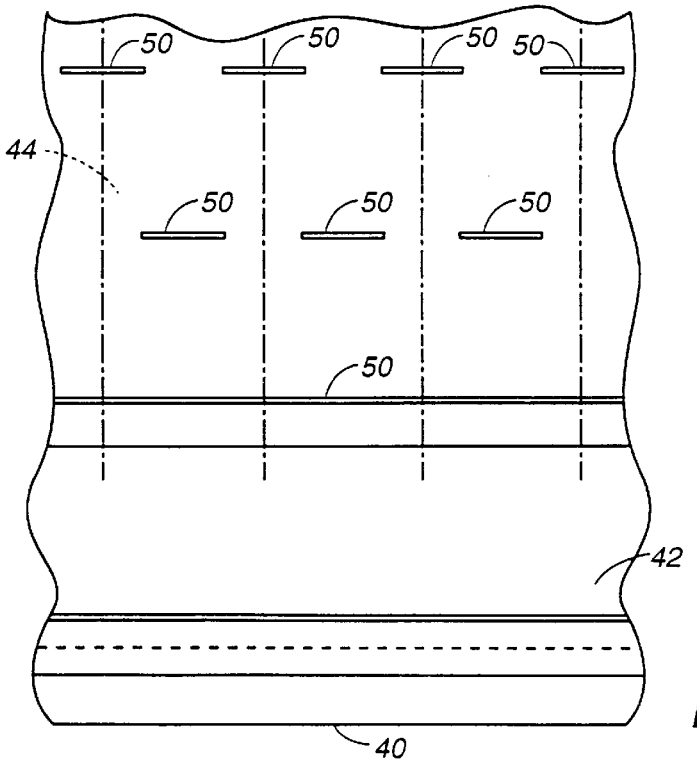
FIG. 7 is a diagrammatic view depicting a portion of the apparatus as designated by line 7—7 in FIG. 5.

An igniter is preferably located in the hood interior to ignite the gas burners and a flame detector is preferably employed to detect the existence or absence of gas burner flame. Suitably, only one igniter need be deployed in each hood section to ignite all of the gas burners in a particular hood section. As shown in FIG. 6, the burners preferably incorporate structure which will propagate flame one to the other. More particularly, tubes 98 communicating with the interiors of the burners project from opposed sides thereof to pass the flame along to adjoining tubes of adjoining burners. Preferably, such tubes are spaced along the length of the burners.

I claim:

1. Apparatus for drying a wet web and modifying the moisture profile of said wet web, said apparatus comprising, in combination:

a through air dryer hood defining a hood interior and at least one air supply inlet communicating with said hood interior;

through air dryer web support means mounted for movement relative to said through air dryer hood, said through air dryer web support means for engaging a wet web as said wet web moves in a machine direction in communication with said hood interior; and heater means within said hood interior for heating air within said hood interior during movement of said air from said air supply inlet to said through air dryer web support means for drying said wet web.

2. The apparatus according to claim 1 wherein said heater means comprises a plurality of gas burners located within said hood interior.

3. The apparatus according to claim 2 wherein said gas burners are disposed alongside one another in the cross-machine direction with each gas burner extending only part way along the length of the through air dryer web support means.

4. The apparatus according to claim 3 additionally comprising air flow separator means located between said gas burners and said through air dryer web support means for dividing air flowing through said hood interior between said gas burners and said through air dryer web support means into separate air flow portions, each of said air flow portions being directed toward an incremental width portion of the wet paper web engaging said through air dryer web support means.

5. The apparatus according to claim 4 wherein said air flow separator means comprises a plurality of spaced partitions defining a plurality of heated air flow channels, each of said heated air flow channels located adjacent to a gas burner for receiving air heated thereby.

6. The apparatus according to claim 4 additionally comprising mixing means for mixing and creating turbulence in each of said air flow portions prior to engagement thereof with the wet web engaging said through air dryer support means.

7. The apparatus according to claim 6 wherein said mixing means includes a plurality of mixing elements impacted by said air flow portions.

8. The apparatus according to claim 7 wherein said mixing elements comprise a plurality of mixing bars located between said gas burners and said through air dryer web support means.

9. The apparatus according to claim 3 additionally comprising control means for independently controlling said gas burners to vary the heat applied to air flowing past said gas burners toward said through air dryer web support means.

10. The apparatus according to claim 9 additionally comprising air flow separator means defining a plurality of air flow channels, each of said channels for receiving air heated by one of said gas burners and directing same toward an incremental width portion of the wet web engaging said through air dryer web support means.

11. The apparatus according to claim 2 wherein said gas burners comprise a plurality of elongated nozzles extending in the machine direction.

12. The apparatus according to claim 11 additionally comprising flame shield means projecting from each of said elongated nozzles.

13. The apparatus according to claim 11 additionally comprising igniter means for igniting said elongated nozzles.

14. The apparatus according to claim 1 additionally comprising a perforated air distributor plate located between said heater means and said through air dryer web support means for distributing the flow of said air along said through air dryer web support means.

15. The apparatus according to claim 1 wherein said through air dryer hood includes a plurality of hood sections, each of said hood sections accommodating said heater means.

16. The apparatus according to claim 14 wherein said perforated air distributor plate is located closely adjacent to said through air dryer web support means and substantially conforms to the shape of said through air dryer web support means.

17. Apparatus for drying a wet paper web and modifying the moisture profile of said wet paper web, said apparatus comprising, in combination:

a through air dryer hood defining a hood interior accommodating flowing air;

through air dryer web support means mounted for movement relative to said through air dryer hood, said through air dryer web support means for engaging a wet web as said wet web moves in a machine direction and is engaged by air flowing through said hood interior; and a plurality of gas burners positioned within said hood interior for heating air flowing through said hood interior before said flowing air engages said wet web.

18. The apparatus according to claim 17 additionally comprising control means for controlling said gas burners to vary the heat applied to said flowing air.

19. The apparatus according to claim 18 wherein said gas burners are disposed alongside one another in the cross-machine direction, said control means for independently controlling said gas burners to vary the heat applied to said flowing air by each gas burner.

20. The apparatus according to claim 19 additionally comprising air flow separator means defining a plurality of heated air flow channels, each of said heated air flow channels located adjacent to a gas burner for receiving flowing air heated thereby, said air flow separator means directing the heated air flowing within the heated air flow channels to different incremental width portions of said wet web.

21. Apparatus for drying a wet web and modifying the moisture profile of said wet web, said apparatus comprising, in combination:

a through air dryer hood defining a hood interior accommodating flowing air;

through air dryer support means mounted for movement relative to said through air dryer hood, said through air dryer support means including an outer wall, said outer wall for engaging a wet web as said wet web moves in a machine direction and defining outer wall openings for receiving flowing air from said hood interior;

air flow separator means within said hood interior dividing said flowing air into a plurality of air flow portions disposed side-by-side; and heater means for separately heating said air flow portions.

22. A method of drying a wet web and modifying the moisture profile of said wet web, said method comprising the steps of:

transporting a wet web in a machine direction with said wet web in engagement with a web support having openings therein;

directing flowing air through a passageway and into engagement with said wet web while said wet web is in engagement with said web support;

passing said flowing air through said wet web and through the openings of said web support;

while said flowing air is in said passageway, dividing said flowing air into a plurality of air flow portions disposed side-by-side;

separately heating said air flow portions; and engaging said wet web with said heated air flow portions along different incremental wet web width portions.

23. The method according to claim 22 including the step of independently varying the heat applied to said air flow portions.

* * * * *